United States Patent [19]

Cowley

[11] Patent Number: 5,050,640

[45] Date of Patent: Sep. 24, 1991

[54] WATER SUPPLY INSTALLATION

[76] Inventor: George E. Cowley, 'Idlewild' Bradford Lane, Nether Alderley, Cheshire, England

[21] Appl. No.: 488,152

[22] Filed: Mar. 2, 1990

[51] Int. Cl.[5] ..... F16K 11/24

[52] U.S. Cl. ..... 137/606; 137/614.12

[58] Field of Search ..... 137/605, 606, 607, 24.18, 137/597, 599.1, 240, 241, 614.12

[56] References Cited

U.S. PATENT DOCUMENTS

| | | | |
|---|---|---|---|
| 2,373,702 | 4/1945 | Moen | 137/605 X |
| 2,644,483 | 7/1953 | Parker | 137/605 X |
| 3,359,996 | 12/1967 | Cornelius | 137/614.12 X |
| 3,417,782 | 12/1968 | Mentnech | 137/607 X |
| 4,444,215 | 4/1984 | Zukausky | 137/606 X |
| 4,474,149 | 10/1984 | Idogaki | 137/624.18 X |
| 4,685,156 | 8/1987 | Brabazon | 137/607 X |

*Primary Examiner*—Stephen M. Hepperle
*Attorney, Agent, or Firm*—Skjerven, Morrill, MacPherson, Franklin & Friel

[57] ABSTRACT

A water supply installation such as a mixing valve (11) has a cold supply (13) and a hot supply (12). An outlet (14) is controlled by a valve (15) and in order that the temperature of the installation (11) can be raised after closure of the valve (15), means, such as an isolating solenoid valve (20) is provided which isolates the cold supply (13) from the body of the installation so that the body of the installation is supplied only with hot water after switching off, the rise in temperature being effective to prevent and or discourage growth of dangerous bacteria.

12 Claims, 2 Drawing Sheets

WATER SUPPLY INSTALLATION

This invention relates to water supply installations which include a hot and cold supply and a facility for mixing such hot and cold supplies to supply water to end use such as a shower, bath or comparable purposes. Normally such an installation will be in the form of a mixing valve.

Much attention has recently been focused upon the problem caused by the Legionaellae bacillus. Such bacillus causes problems in connection with showers, baths, spa facilities, bidets and other industrial and commercial installations. The problem is particularly acute in public facilities and is particularly severe in relation to showers wherein aerosols are created and injested into the human lungs.

The Legionaellae bacterium is a common one and survives and multiplies in water. It is widespread in natural fresh water including lakes, rivers and ponds. There is a likelihood of low concentrations existing in open water systems including those in building services, for example in the cold water tanks often used to supply cold water systems in buildings and to supply hot water systems. The bacillus also lives and breeds in sludge and waste deposits containing moisture. Such sludge and waste deposits can often exist inside pipework and valves.

The health hazard is created when low concentrations of the bacillus breed and multiply which happens under favourable water temperatures, particularly where infected water can remain stagnant for extended periods of time. For example, cold water can reach suitable breeding temperatures during warm summer months due to high ambient temperatures. In warmer climates ambient temperatures may be high enough throughout the year to allow the bacillus to breed to reach dangerous concentrations. In hot water supply systems there can often be "deadlegs" which allow the water within the "hot" system to fall to a favourable temperature which is conducive to breeding.

According to laboratory tests as described in the Department of Health & Social Security publication, published in 1988, under the title "The Control of Legionellae in Health Care Premises - A Code of Practice", the following statistics are given relative to the bacillus:

1. The most favoured breeding temperature is around 37° C.
2. at 46° C. multiplication of the bacillus ceases, but it is still active, and infective.
3. At 50° C. survival of the bacillus is a matter of hours.
4. At 60° C. survival is a matter of minutes only.
5. At 70° C. the bacteria is killed off instantly.
6. Reducing the temperature below around 37° C. progressively reduces the breeding capability down to around 20° C. at which temperature the breeding rate becomes insignificant.
7. At lower temperatures than 20° C. the bacillus becomes dormant, but breeding will resume as temperatures rise.

It is an object of the present invention to take account of the above problem and provide an improved water supply installation.

The invention provides a water supply installation which includes a hot supply and a cold supply and an outlet having an outlet valve, wherein means are provided which, upon closure of the outlet valve after use at least temporarily blocks flow connection from the cold supply thus allowing hot water from the hot supply to raise the temperature of the installation.

After use, the hot supply conduit will be full of water at a high temperature. In Health Building Note Reference No. 37, Hospital Accommodation for Elderly People, published by the Department of Health & Social Security, Welsh Office, Section4, Engineering Services, paragraph 4.35 "Hot Water Supply", it is recommended that hot water should be stored at 60° C., but reduced at the point of discharge into baths, showers etc., to a blended water temperature not exceeding 43° C. Water installations suitable for effecting such blending are the subject of the present application.

It will be seen that as the hot water supply will almost always be at 60° C., after cutting off of the outlet valve flow from the cold supply into the installation is prevented and, therefore, water and/or heat from the connected hot supply causes the temperature of the installation to rise. As the hot water supply will normally be at 60° C. the temperature of the installation can very easily rise to between 55° and 60° C., even if the installation is completely uninsulated. This rise in temperature is sufficient to kill Legionallea bacillus by immersing them in hot water for considerable time after the installation has been turned off.

The installation of the invention can, if desired, be used in connection with an automatic drain for an upwardly extending outlet (for example a shower) which might remain filled with water after the installation has been shut off.

The installation can be a mixing valve.

Said means can include a sensor adapted to sense that the outlet has been turned off and connected via control circuitry to actuate a solenoid valve to cut off the cold supply. Preferably, the valve is such as to thermally insulate the cold supply, for example by being made from plastics material and having a valve member also of plastics material. As there is no question of forming a pressure tight seal for the cold supply, the cold water isolating valve can be of the gate valve type or other relative cheap valve. As an alternative to the sensor and solenoid operated valve, it would be possible for a mechanical cold water cut off device to be incorporated into a valve body and connected to be operated simultaneously with an outlet valve.

The sensor could be a magnetic reed switch operated by a member carried by, for example, a handle of the closure valve. Alternatively, a proximity or comparable sensor could be used.

In order to counteract the cooling effect of the cold supply on parts of the installation adjacent the cold supply, it is possible for there to be provided a bypass flow connection from the hot side of the installation to the cold side. This would allow a direct flow of hot water to the cooler side. Said means can be such that the cold inlet to the installation is shut off slightly in advance of final closing of the outlet valve, thus ensuring that the final flow of water into the installation is purely hot water thus encouraging a rise of temperature within the installation. The timing should be chosen so that no significant amount of unmixed hot water is discharged from the outlet.

The invention will be described further, by way of example, with reference to the accompanying drawing wherein.

Figure 1:
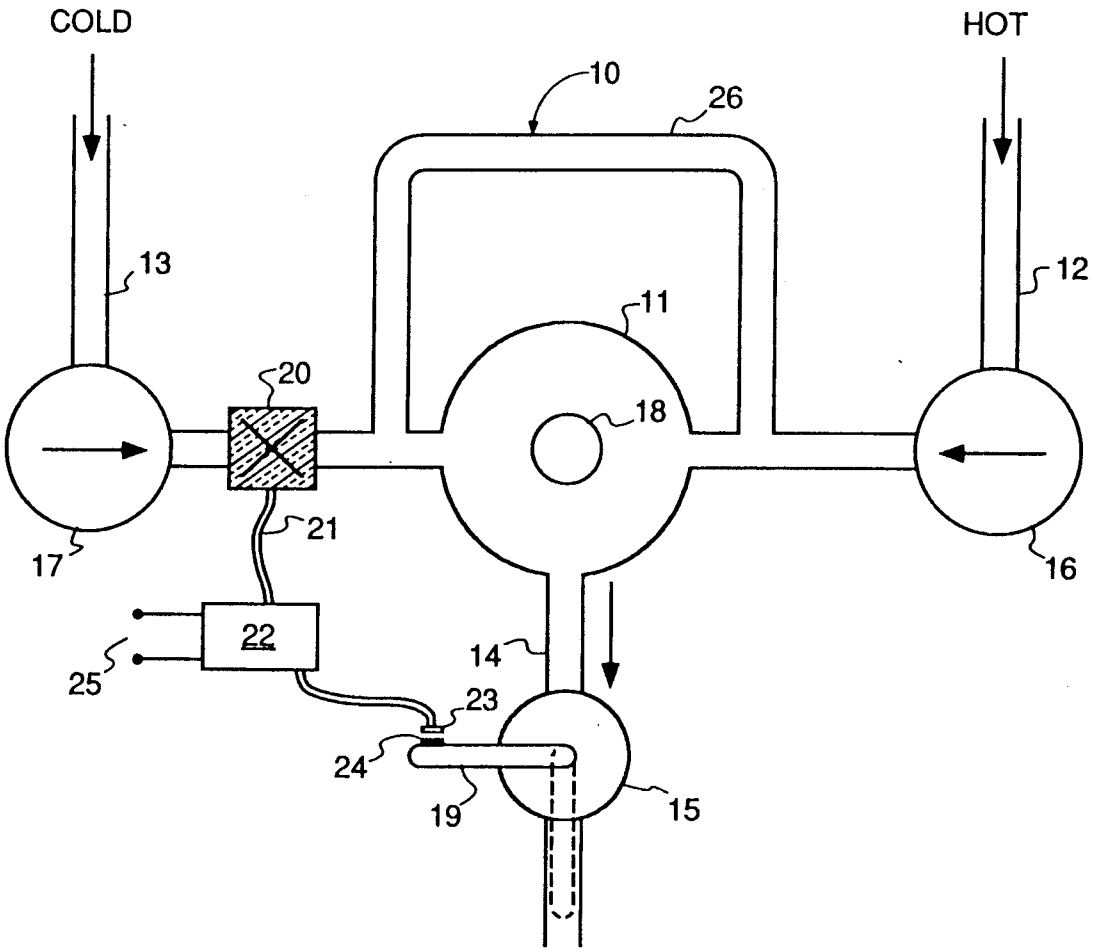
FIG. 1 is a schematic illustration of a preferred embodiment of water supply installation of the invention.

In FIG. 1, a preferred water supply installation of the invention is illustrated in the form of a mixer valve 10. The valve 10 has a mixer body 11, a hot inlet 12, a cold inlet 13, and an outlet 14 controlled by an outlet valve 15. The hot inlet has a one-way valve 16 and the cold inlet has a comparable valve 17. A conventional mixer mechanism (of no relevance to the present invention) is provided within the body 11 and can be controlled by means of a knob 18.

As described heretofore, the mixer valve 10 is completely conventional and receives cold water from the mains at a usually fixed temperature and hot water from a hot supply at perhaps 60° C. The temperature of water issuing from the outlet 14 is determined by alteration of a knob 18 and flow is controlled by means of the outlet valve 15 which is a lever valve having a handle 19 which, in its horizontal position is closed and in its vertical position (shown in dotted lines) is open.

The valve 10 of the invention differs from a conventional valve in that in the fluid flow path from the valve 17 to the body 11 is provided a solenoid operated shut-off valve 20 which can be actuated by power passing through cable 21 from control box 22. Solenoid valve 20 has a low voltage solenoid for safety, for example operating off 24 volts. The valve 20 can be a simple gate valve or comparable item as it does not have to seal against mains pressure. Slight leakage is not of great significance. In FIG. 1, the valve 20 is of plastics material in order to have a heat insulating effect.

Control box 22 is connected to a sensor 23 which can be a magnetic reed switch actuable by a magnet 24 carried by the handle 19. Power is supplied to box 22 from an input 25.

Thus, when the handle 19 is moved from its open position towards its closed position there comes a time when the magnet 24 approaches sensor 23 which sends a signal to the control box 22 which passes a current to the solenoid valve 20 which closes it. Preferably, this closure is timed to occur slightly before the handle 19 reaches its fully closed position. This cuts off cold water supply to the body 11 slightly before hot water is prevented from flowing by total closure of valve 15. In either case, after shut-off the body 11 is connected only to the hot water supply via the one-way valve 16. One-way valve 16 will prevent any significant flow back into the hot supply, but it will not prevent intermingling of the water on opposite sides of the valve 16 when they are at approximately the same pressure. Conduction and convection within the body 11 and the associated pipework ensures that the whole rapidly reaches a relatively high temperature whose value is dependent on the temperature of the water in the supply 12. As the installation has just been in use, the supply 12 will normally be at its relatively high temperature which can be 60° C. in a typical installation. After actuation of the valve 20 the whole installation including the body 11, outlet valve 15 and the two connecting flow passages can very rapidly reach temperature very close to 60° C. at which temperature the Legionallae bacillus are killed. By ensuring that the water supply temperature is raised to say 65° C., it can be ensured that the mixer valve 10 reaches a temperature of 60° C., at which temperature all Legionella bacilli bacicullus are killed within minutes.

It has been found that the side of the mixer valve 10 nearest to the cold supply can fail to reach a sufficiently high temperature due to conduction of heat through the one-way valve back to the cold supply. To prevent this, it has been mentioned that the valve 20 can serve as a thermal insulator. However, to assist the flow of hot water to the cold side of the mixer valve, a bypass 26 can be provided. This can be in the form of a separate tube outside the valve, or, upon manufacture, could be incorporated within the valve to allow direct passage of a certain amount of hot water directly to the cold side of the mixer valve to enable the entire installation to reach a high temperature after switch off.

Instead of the sensor operated solenoid valve 20 being used, a valve 20 which is mechanically connected to the valve 15 could equally be used. However, the system described above is particularly suitable for connection as a kit to existing valves.

In a brand new valve, it would probably be feasible to incorporate the cut off of the cold supply mechanically with the shut off valve 15. It would, however, be important to ensure that a thermal flow connection between the cold side and the mixer valve was not created by this structure.

Figure 2:
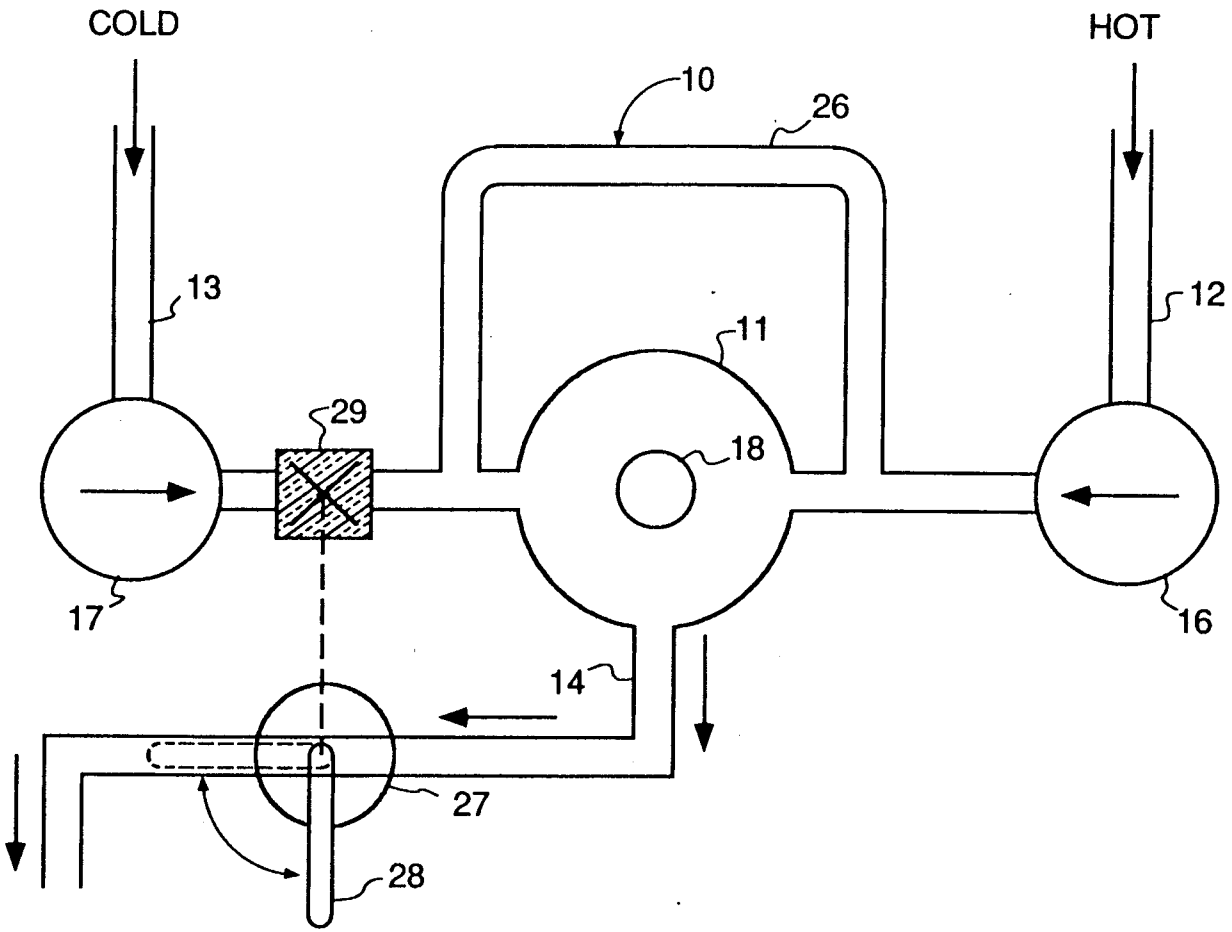
FIG. 2 is a schematic illustration of another embodiment of water supply installation of the invention.

Many different forms of sensor other than the magnetic sensor can be used. For example, a proximity switch or even a mechanical linkage could be used. FIG. 2 shows schematically a mechanical linkage between an outlet valve 27 and a mechanically actuable shut-off valve 29 which is moved from an open to a closed position when a handle 28 of outlet valve 27 reaches its closed position.

In commonly used applications where a shower spray system is used in conjunction with a trigger type water discharge through the nozzles, omitting an additional outlet control valve from the mixer, a mounting holder for the shower attachment is envisaged by means of which the act of placing the shower fitment onto/into an adapted holder will perform a similar function to that described by handle 19. this can be achieved by having the sensor on the holder and the magnet or the like on the shower handset.

The invention is applicable to water supply installations other than mixing valves.

Many other variations are possible within the scope of the invention.

I claim:

1. An improved water-mixing installation which includes a body; a first conduit for supplying hot water to said body; a second conduit for supplying cold water to said body; an outlet flow path for said body; an outlet valve in said outlet flow path; wherein the improvement comprises:

a cut-off valve in said second conduit only; and an operative connection connected between said cut-off valve and said outlet valve to close said cut-off valve upon closure of said outlet valve, said first conduit remaining in flow connection with said body;

to prevent further flow of cold water to said body and to prevent mixing of cold water in said second conduit with water in said body, and to promote thermal transfer between hot water in said first conduit and water in said body;

wherein said cut-off valve is a solenoid valve and wherein said operative connection includes a sensor adapted to sense that said outlet valve has been closed and control circuitry connecting said sensor and said solenoid valve, said solenoid valve being closed upon the activation of said circuitry by said sensor.

2. An installation as set forth in claim 1 wherein said sensor is a magnetic reed switch.

3. An installation as set forth in claim 2 wherein said outlet valve includes a handle for controlling said valve and wherein said reed switch is operated by a member carried by said handle.

4. An installation as set forth in claim 1 wherein said sensor is a proximity sensor.

5. An improved water-mixing installation which includes a body; a first conduit for supplying hot water to said body; a second conduit for supplying cold water to said body; an outlet flow path for said body; an outlet valve in said outlet flow path; wherein the improvement comprises;

a cut-off valve in said second conduit only; and an operative connection connected between said cut-off valve and said outlet valve to close said cut-off valve upon closure of said outlet valve, said first conduit remaining in flow connection with said body;

to prevent further flow of cold water to said body and to prevent mixing of cold water in said second conduit with water in said body, and to promote thermal transfer between hot water in said first conduit and water in said body;

wherein a bypass flow connection is provided from said first conduit to a part of the body adjacent said second conduit to allow a direct flow of hot water to cooler parts of the installation.

6. An improved water-mixing installation which includes a body; a first conduit for supplying hot water to said body; a second conduit for supplying cold water to said body; an outlet flow path for said body; an outlet valve in said outlet flow path; wherein the improvement comprises:

a cut-off valve in said second conduit only; and an operative connection connected between said cut-off valve and said outlet valve to close said cut-off valve upon closure of said outlet valve, said first conduit remaining in flow connection with said body;

to prevent further flow of cold water to said body and to prevent mixing of cold water in said second conduit with water in said body, and to promote thermal transfer between hot water in said first conduit and water in said body;

wherein said operative connection is such that said cut-off valve is closed slightly in advance of final closing of said outlet valve to insure a final flow of hot water only into said body, said final flow remaining in said body.

7. An improved water-mixing installation which includes a body; a first conduit for supplying hot water to said body; a second conduit for supplying cold water to said body; an outlet flow path for said body; an outlet valve in said outlet flow path; and a mixture ratio controller for controlling the relative proportions of hot water and cold water in said outlet flow path; wherein the improvement comprises:

a cut-off valve in said second conduit only; and an operative connection connected between said cut-off valve and said outlet valve to close said cut-off valve upon closure of said outlet valve, said first conduit remaining in flow connection with said body;

to prevent further flow of cold water to said body and to prevent mixing of cold water in said second conduit with water in said body, and to promote thermal transfer between hot water in said first conduit and water in said body.

8. An installation as set forth in claim 7 wherein the installation is a mixing valve.

9. An installation as set forth in claim 7 wherein said cut-off valve thermally insulates said second conduit from said body.

10. An installation as set forth in claim 9 wherein said cut-off valve is made of plastics material.

11. An installation as set forth in claim 7 wherein said outlet valve includes a handle for controlling said valve, said cut-off valve is a mechanically actuable valve, and said operative connection is a mechanical link which closes said cut-off valve when said handle is moved to a closed position.

12. An improved water-mixing installation which includes a body; a first conduit for supplying hot water to said body; a second conduit for supplying cold water to said body; an outlet flow path for said body; an outlet valve in said outlet flow path; wherein the improvement comprises:

a cut-off valve in said second conduit only;

a sensor for detecting closure of said outlet valve; and an operative connection connected between said sensor and said cut-off valve for closing said cut-off valve upon closure of said outlet valve, said first conduit remaining in flow connection with said body;

to prevent further flow of cold water to said body and to prevent mixing of cold water in said second conduit with water in said body, and to promote thermal transfer between water in said first conduit and water in said body.

* * * * *

UNITED STATES PATENT AND TRADEMARK OFFICE

CERTIFICATE OF CORRECTION

PATENT NO. : 5,050,640

DATED : September 24, 1991

INVENTOR(S) : George E. Cowley

It is certified that error appears in the above-identified patent and that said Letters Patent is hereby corrected as shown below: On the title page: Insert the following:

Foreign Application Priority Data

March 2, 1989 (GB) United Kingdom ..... 8904791.4

Signed and Sealed this

Twenty-first Day of September, 1993

Bruce Lehman

*Attest:*

BRUCE LEHMAN

*Attesting Officer*

*Commissioner of Patents and Trademarks*